United States Patent [19]

Allison

[11] 4,272,020

[45] Jun. 9, 1981

[54] GUNNING APPARATUS FOR IN SITU SPRAYING OF REFRACTORY MATERIAL

[75] Inventor: Ralph E. Allison, Wheelersburg, Ohio

[73] Assignee: BMI Inc., Pittsburgh, Pa.

[21] Appl. No.: 97,238

[22] Filed: Nov. 26, 1979

Related U.S. Application Data

[63] Continuation of Ser. No. 934,327, Aug. 16, 1978, Pat. No. 4,211,367, which is a continuation-in-part of Ser. No. 780,268, Mar. 23, 1977, abandoned.

[51] Int. Cl.[3] ..... B05B 3/02; C21B 7/06

[52] U.S. Cl. ..... 239/8; 239/10; 266/281

[58] Field of Search ..... 239/1, 9, 10, 186, 187, 239/225-227, 246, 264; 266/281

[56] References Cited

U.S. PATENT DOCUMENTS

| | | | |
|---|---|---|---|
| 2,082,330 | 6/1937 | Frede et al. | 239/227 |
| 2,785,008 | 3/1957 | Young | 239/227 |
| 2,858,836 | 11/1958 | Geh et al. | 239/225 X |
| 3,001,534 | 9/1961 | Grant, Jr. | 239/227 X |
| 3,420,444 | 1/1969 | Ajnefors | 239/227 X |
| 3,460,988 | 8/1969 | Kennedy, Jr. et al. | 239/227 X |
| 3,797,745 | 3/1974 | Haus | 239/227 X |
| 3,799,445 | 3/1974 | Marino | 239/227 X |
| 3,931,959 | 1/1976 | Truman | 239/599 X |
| 4,085,894 | 4/1978 | Kubo et al. | 239/227 X |
| 4,099,708 | 7/1978 | Morris et al. | 239/227 |

*Primary Examiner*—Andres Kashnikow

*Attorney, Agent, or Firm*—Stanley J. Price, Jr.; John M. Adams

[57] ABSTRACT

A housing having an interior chamber with an inlet and outlet thereto is suspended by a crane within a ladle or furnace having an interior refractory surface to be relined. A feed conduit for conveying dry refractory material entrained in an air stream extends through the inlet into the interior chamber. A nozzle assembly having a pair of oppositely positioned spray nozzles is rotatably supported in the outlet of the housing. A conduit of the nozzle assembly is rotatably connected at one end by a coupling to the feed conduit within the housing and communicates with the spray nozzles. Each of the spray nozzles includes a water ring that receives a wetting agent, such as water, from a supply conduit that is connected by a swivel assembly to the nozzles to permit rotation of the nozzles relative to the supply conduit. Each water ring directs the water into mixture with the air entrained dry refractory material flowing through the nozzle. A reversible, variable speed motor is drivingly connected to the nozzle conduit within the housing and is remotely controlled to oscillate the nozzle assembly at a preselected rate through an arc of a preselected angle to apply the refractory material to a worn quadrant of the interior surface.

14 Claims, 3 Drawing Figures

GUNNING APPARATUS FOR IN SITU SPRAYING OF REFRACTORY MATERIAL

CROSS REFERENCE TO RELATED APPLICATIONS

This application is a continuation of co-pending application Ser. No. 934,327 filed on Aug. 16, 1978, entitled "Gunning Apparatus For In Situ Spraying Of Refractory Material" by Ralph E. Allison now U.S. Pat. No. 4,211,367, which in turn is a continuation in part of application Ser. No. 780,268 filed on Mar. 23, 1977, entitled "Gunning Apparatus For In Situ Spraying Of Refractory Material" by Ralph E. Allison now abandoned.

BACKGROUND OF THE INVENTION

1. Field of the Invention

This invention relates to a gunning apparatus and method for applying a refractory product in situ on the interior surface of a refractory body at an elevated temperature and more particularly to a nozzle assembly rotatably supported within the refractory body for rotation at a preselected speed in a preselected direction to apply the refractory product to a selected area of the interior surface.

2. Description of the Prior Art

The refractory bodies used in the iron and steel industry for carrying, holding and pouring of molten metal such as metallurgical ladles, blast furnaces, soaking pits, cupolas and the like are exposed to elevated temperatures over a long period of use that results in deterioration of the interior refractory surface. Consequently, the surface must either be periodically replaced or repaired. The interior surface may be repaired in a number of ways such as laying of refractory brick over the deteriorated surface. However, in order to reduce the labor costs of brick laying, the refractory industry has utilized high temperature plastic refractories having a pliable construction to permit shaping of the material to the contour of the interior surface being relined. The preshaped plastic refractory material is installed by pneumatic hammers to mold the refractory lining to the contour of the interior surface. It is also known to utilize a heat resistant castable cement refractory that is installed on the interior surface in a manner similar to the installation of conventional castable cement. This requires a substantial work force and the erection of frames to contain the castable refractory cement for curing.

More commonly the deteriorated surface of a ladle or blast furnace is reconditioned and repaired by the gunning application of a refractory material that is formed by mixing a dry mix of refractory binder and aggregate propelled through a hose by a stream of compressed air to a nozzle where a wetting agent, such as water, is supplied for mixture with the dry refractory to form a refractory product in a slurry. The refractory product is sprayed onto the interior surface. Typical of such gunning assemblies is the apparatus illustrated and described in U.S. Pat. No. 3,931,959. However, inherent with this method of gunning, as well as the above described methods, is the problem of cooling the ladle or furnace before the relining operation can be carried out. These methods require the installation personnel to work within the interior of the ladle or furnace; therefore, the surface to be relined must be allowed to cool prior to the relining operation. Thus, the ladle or furnace must be removed from operation to permit it to cool. This takes a considerable period of time which disrupts the steel making process, particularly when the relined ladle or furnace must be reheated to a preselected elevated temperature before restored to operation.

Lining guns for automatically spraying a refractory material upon the interior surface of a ladle or blast furnace, maintained at an elevated temperature, are well known as illustrated and described in U.S. Pat. No. 3,797,745. There a pair of concentrically positioned conduits separately supplies dry refractory material entrained in air and a wetting agent to a mixing nozzle where the wetting agent is mixed with the dry refractory material. The resultant refractory product is discharged from a pair of oppositely positioned nozzles onto the interior surface. The nozzle assembly is axially positioned within the ladle or furnace and the discharge nozzles are rotated as the assembly is moved from the bottom toward the top of the ladle to completely and entirely spray the interior surface. Because the relining operation is carried out at an elevated temperature the motor is subjected to the deleterious effects thereof resulting in malfunction. In addition the relining operation may require that only a portion of interior surface be relined with the refractory product as opposed to relining the entire interior of the ladle.

U.S. Pat. No. 3,799,445 discloses a remote-controlled refractory gunning apparatus that includes a mixing head having a refractory supply conduit connected to a swivel coupling by a water supply tee to which a water supply conduit is connected. A rotatable conduit extends downwardly from the swivel coupling and has a nozzle for spraying the mixed refractory and water onto the wall of a vessel to be relined. U.S. Pat. Nos. 2,785,008 and 2,858,836 disclose tank cleaning devices in which the former utilizes a reversible motor for rotating nozzle assemblies from which streams of liquid are discharged and the latter includes a nozzle head having a plurality of outlets that are oscillated in a vertical plane to spray only the top surface and upper end portion of a tank. Cleaning devices utilizing nozzles for directing a stream of fluid in a preselected direction are disclosed in U.S. Pat. Nos. 3,460,988; 3,420,444; 3,001,534; 2,858,836 and 2,082,330.

There is need to provide a gunning apparatus for applying a refractory product in situ upon the interior surface of a refractory body heated to an elevated temperature where the refractory product may be efficiently applied to a limited area of the interior surface as well as to the entire area of the interior surface.

SUMMARY OF THE INVENTION

In accordance with the present invention there is provided a gunning apparatus for spraying a refractory product in situ upon the interior surface of a refractory body that includes a housing having an interior chamber with an inlet and outlet thereto. A feed conduit extends through the inlet for conveying a stream of dry refractory material. A nozzle assembly is rotatably supported in the housing outlet. The nozzle assembly has an inlet positioned within the housing and an outlet extending from the housing. A supply conduit is provided to convey a wetting agent to the nozzle assembly for mixture with the stream of dry refractory material to form a spray of refractory product from the outlet of the nozzle assembly. A swivel assembly connects the supply conduit to the nozzle assembly to permit rotation of the nozzle assembly relative to the supply conduit as the wetting agent is conveyed to the nozzle assembly. A drive mechanism is supported within the housing and is connected to the nozzle assembly for rotating the nozzle assembly at a preselected speed in a preselected direction to apply the refractory product onto a preselected area of the interior surface of the refractory body.

The housing is suspended from a crane and is positioned axially within the refractory body, such as a ladle or blast furnace, having an interior refractory surface to be reconditioned by applying the refractory product to the deteriorated portions of the interior surface. The supply of dry refractory material and wetting agent, such as water, to the nozzle assembly is remotely controlled, as well as the rotation of the nozzle assembly. The dry refractory material is conveyed from a source by a stream of air that is conducted through the feed conduit at a preselected volume flow rate and at a preselected pressure. In this manner the dry refractory material is conveyed in a stream to the nozzle assembly. The wetting agent is conducted through the supply conduit which is connected at the outlet end portion thereof to the swivel assembly.

One embodiment of the swivel assembly includes a fixed or stationary tubular portion which is secured to and extends downwardly from the outlet of the housing in surrounding relation with the nozzle assembly. The nozzle assembly is rotatable relative to the tubular portion which is nonrotatable. The tubular portion has an opening connected to the outlet end portion of the water supply conduit. The water supply conduit passes through the interior of the housing and exits therefrom adjacent the outlet of the housing. A rotatable portion of the swivel assembly is nonrotatably connected at a lower end in surrounding relation with the nozzle assembly below the tubular portion. The rotatable portion has an upper end rotatably positioned on the tubular portion and includes a fluid chamber communicating with the opening in the tubular portion. A pair of conduits secured to the rotatable portion conveys the wetting agent, which passes from the tubular portion opening to the fluid chamber, from the swivel assembly to a pair of spray nozzles of the nozzle assembly for mixture with the dry refractory material.

Preferably, the nozzle assembly includes a pair of oppositely positioned spray nozzles that are each threadedly engaged to a water ring. The water ring is, in turn, threadedly engaged to a cap portion at the base of the nozzle assembly. The cap portion includes internal passageways that convey the dry refractory material to the respective water rings. The wetting agent is conveyed to the water rings from swivel assembly by the pair of conduits. The wetting agent and dry refractory material are mixed in the water rings to form the refractory product. The spray nozzles are positioned opposite one another to direct a spray of the refractory product outwardly from the center axis of the refractory body onto the interior surface thereof.

The drive mechanism includes a reversible, variable speed air motor that is supported within the housing and includes a drive shaft that is drivingly connected by a belt through a drive pulley and a driven pulley to the conduit of the nozzle assembly inside the housing. The rate of rotation of the nozzle assembly is variable and is selectively controlled. The direction of rotation, i.e. clockwise or conterclockwise, as well as the rate of rotation, is remotely controlled so that the nozzle assembly may be rotated in a preselected direction at a rate of rotation between about ½ to 30 revolutions per minute.

Once the nozzle assembly is axially positioned within the ladle or furnace to locate the outlets of the spray nozzles oppositely of the point of application, the nozzle assembly may be rotated in a selected direction to provide a circular spray and uniformly coat the entire interior surface. On the other hand, the direction of rotation of the nozzle assembly may be reversed to oscillate the spray nozzles back and forth through an arc of a preselected angle to apply the spray to a preselected area or quadrant of the interior surface. With this arrangement the rotational speed and rate of reversing the direction of rotation is variable. This operation is particularly desirable when only a portion of the interior surface requires repair by relining.

The refractory product is applied to the interior surface of the refractory body at the elevated operating temperature of the body. By conducting the gunning operation at an elevated temperature, it is not necessary to cool the refractory body before the gunning operation is carried out. To protect the drive mechanism from the deleterious effects of the high temperature within the ladle or furnace the interior surface of the housing is lined with a suitable insulation material. In addition, the motor is maintained at an efficient operating temperature by conducting air into the housing from an air supply conduit. A ventilation port is provided in the housing so that the air circulates throughout the interior chamber of the housing and around the motor to maintain the motor at a preselected operating temperature.

Accordingly, the principal object of the present invention is to provide a gunning apparatus for spraying a refractory product in situ upon the interior surface of a refractory body by a nozzle assembly that is positioned within the body and rotated at a preselected speed in a preselected direction to apply the refractory product upon a selected portion of the interior surface.

Another object of the present invention is to provide a gunning apparatus that permits the remote application of a refractory product upon the interior surface of a refractory body such as a ladle, blast furnace and the like by rotating a nozzle assembly at a preselected rate in a preselected direction to apply the refractory product upon the interior surface of the body and thereby repair the interior surface maintained at the elevated operating temperature of the refractory body.

A further object of the present invention is to provide a gunning apparatus that includes a swivel assembly for connecting the water supply conduit to the nozzle assembly to permit rotation of the nozzle assembly relative to the water supply conduit as water or any other suitable wetting agent is conveyed to the nozzle assembly.

These and other objects of the present invention will be more completely disclosed and described in the following specification, the accompanying drawings and the appended claims.

DESCRIPTION OF THE PREFERRED EMBODIMENT

Figure 1:
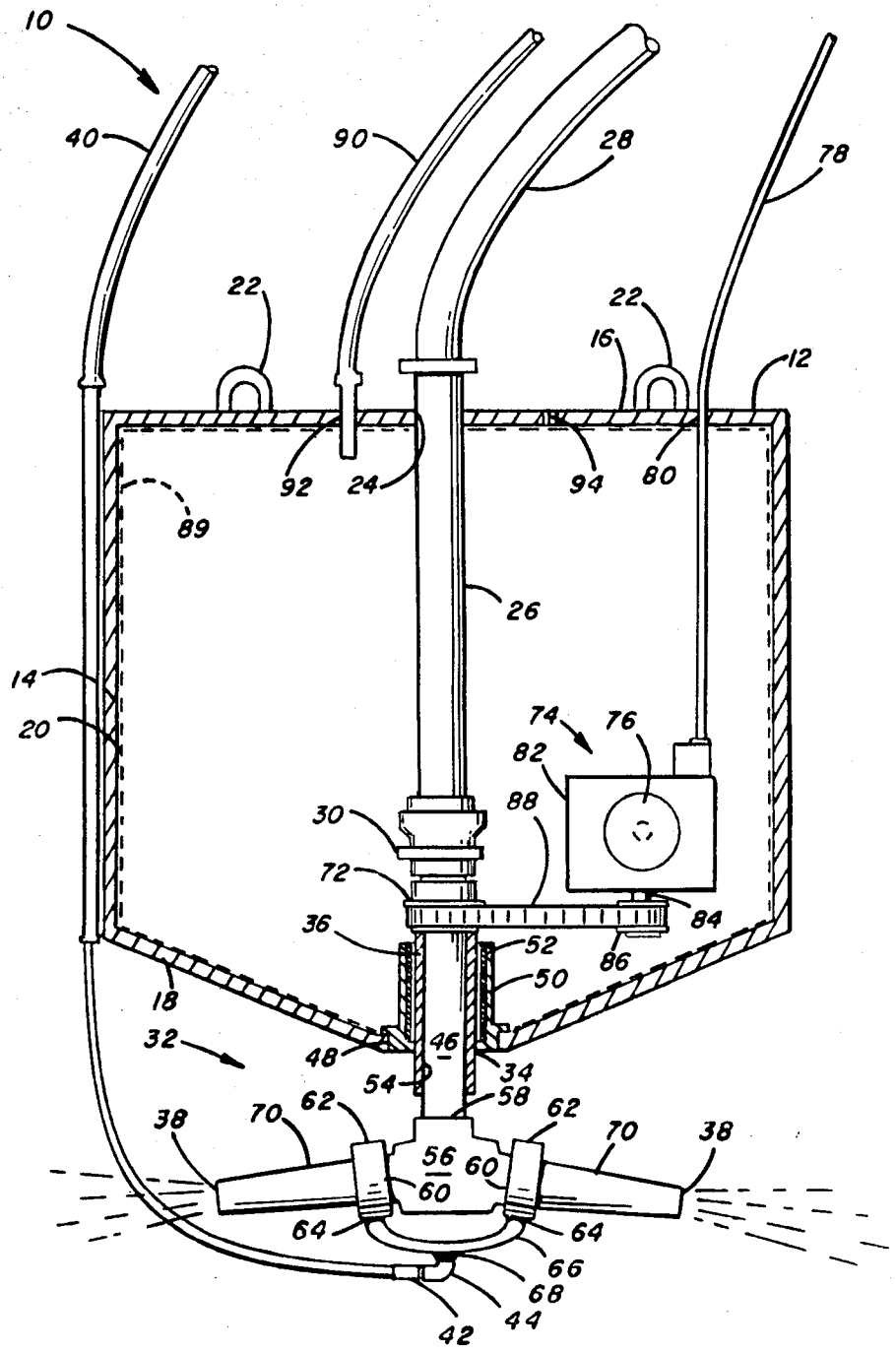
FIG. 1 is a view in side elevation and partially in section of a gunning apparatus for applying in situ a refractory product to the interior surface of a refractory body illustrating one embodiment of a swivel device for connecting the water supply conduit to the nozzle assembly.

Referring to the FIG. 1 there is illustrated a gunning apparatus generally designated by the numeral 10 for applying in situ a refractory product to the interior surface of a refractory body, such as a metallurgical ladle used in the carrying, holding and pouring of molten metal, high temperature furnaces, such as oxygen vessels, open hearth furnaces, blast furnaces and other refractory installations, such as soaking pits and cupolas, to recoat or reline the deteriorated interior surface of the refractory body. The gunning apparatus 10 includes an elongated housing 12 having vertical cylindrical side walls 14 with a cover plate 16 and a conical base 18 secured to opposite ends of the side walls to thereby form an interior chamber 20. A pair of eyelets 22 are secured to and extend upwardly from the cover plate 16. The gunning apparatus 10 is suspended above the refractory body by hooks engaging the eyelets 22 and lowered by a cable fed from an overhead crane. In this manner, the housing 12 is axially lowered into the refractory body for movement through the interior thereof as the refractory product is sprayed onto the entire interior surface or onto a selected area thereof in accordance with the present invention.

The gunning apparatus 10 is lowered into the open end portion of the hot ladle or blast furnace and is operated from a control panel positioned remote of the gunning location. The cover plate 16 includes an inlet 24 through which a material feed conduit 26 extends. The upper end portion of conduit 26 projects from the housing chamber 20 and is connected to an elongated flexible conduit 28 which communicates at its opposite end (not shown) with a pressure chamber containing dry granular refractory material. Air under pressure is conducted from a compressor into the chamber and in a well known manner the dry refractory material is entrained in the air stream and conveyed from the chamber through conduit 28. The gunning operator controls the feed of the refractory material entrained in air through the conduit 28. From the conduit 28 the refractory material passes to the feed conduit 26 which is connected by a rotary coupling 30 to a nozzle assembly generally designated by the numeral 32.

The nozzle assembly 32 is rotatably supported within an outlet 34 of housing 12 by a sleeve bearing 36. The nozzle assembly 32 includes one or more outlets 38 from which a refractory product is sprayed onto the interior surface of the ladle or furnace. The refractory product is formed by the addition of a wetting agent, such as water, to the stream of dry refractory material in the nozzle assembly 32. Water is supplied to the nozzle assembly 32 through a water supply conduit 40 having a suitable length to extend from a source. The operator of the gunning apparatus 10 controls the flow of water through conduit 40 by a valve at the control panel (not shown). The water supply conduit 40 has an end portion 42 that is connected by a swivel mechanism 44 to the nozzle assembly 32. This permits the nozzle assembly 32 to rotate relative to the water supply conduit 40.

The nozzle assembly 32 includes a conduit 46 that is connected to the rotary coupling 30 to permit rotation of the conduit 46 within the housing 12. The rotary coupling 30 includes a sealed passageway for the flow of refractory material from the feed conduit 26 to the conduit 46. With this arrangement the conduit 46 is rotatable within the housing 12 as the feed conduit 26 remains stationary within the housing 12. The outlet 34 of the housing 12 is axially aligned with the inlet 24. The conical base 18 of the housing 12 converges inwardly from the cylindrical sidewalls 14 to an opening 48. A flanged sleeve member 50, welded to the conical base 18, is positioned within the opening 48. The flanged sleeve member 50 is axially supported within the opening 48 and includes a passageway 52 to form the outlet 34 of the housing 12. The sleeve bearing 36 is supported by the sleeve member 50 and includes a bore 54 through which the conduit 46 of the nozzle assembly 32 extends. The sleeve bearing 36 rotatably supports the conduit 46 within the housing outlet 34.

The lower end portion of the conduit 46 is threadedly connected to a cap 56. The cap 56 includes an inlet 58 surrounding the end of conduit 46 and a pair of outlets 60 that are angularly displaced relative to the inlet 58. The cap 56 includes an internal passageway that connects the inlet 58 with the outlets 60. With this arrangement the air entrained, dry refractory material flows from the feed conduit 26 into the nozzle conduit 46 and therefrom to the cap 56. The dry refractory material is directed through the internal passageway of the cap 56 to the respective outlets 60. The outlets 60 are substantially at right angles to the inlet 58.

A water ring 62 is threadedly secured to each of the outlets 60 of the cap 56. Each water ring 62 includes an inlet port 64 that communicates with a circumferential passageway surrounding an axial passageway. A plurality of radially positioned apertures connect the circumferential passageway with the axial passageway. The inlet ports 64 are connected by a tee conduit 66 to the swivel mechanism 44. The swivel mechanism 44 is connected to a branch conduit 68 of the tee conduit 66 to permit the tee conduit to rotate relative to the swivel mechanism 44 and the water supply conduit 40.

The wetting agent, preferably water, is supplied by conduit 40 to the water rings 62 and through the internal apertures thereof into mixture with the air entrained stream of dry refractory material. In this manner the water rings 62 serve as mixing chambers for the water and refractory material to produce a refractory product in slurry form. A spray nozzle 70 is threadedly engaged to each water ring 62 and includes the outlet 38 of the nozzle assembly 32. The refractory product passes through the nozzles 70 and is emitted in a spray from the outlets 38. Preferably, as illustrated in FIG. 1, the nozzle assembly 32 includes a pair of spray nozzles 70 that are oppositely positioned and supported by the water rings 62 to project downwardly at an angle to facilitate spraying the base and lower portion of a ladle. Also, this arrangement cancels any resultant thrust applied to the nozzle assembly 32 that would tend to displace it from an axial position within the housing outlet 34.

The nozzle assembly 32 is rotatably supported within the outlet 34 of housing 12 for rotation of the spray nozzles 70 in a preselected direction at a preselected speed to uniformly apply a layer of the refractory product of a preselected thickness upon the interior surface of the refractory body. A pulley 72 is nonrotatably secured to the end of the inlet conduit 46 adjacent the rotary coupling 30. The pulley 72 is drivingly connected to a drive mechanism generally designated by the numeral 74 to rotate the inlet conduit 46 and the entire nozzle assembly 32 at a preselected speed and in a preselected rotary direction.

The drive mechanism 74 preferably includes a reversible air motor 76 that is suitably supported within the housing 12 and receives air flow through a conduit 78 that passes through an opening 80 in the housing cover plate 16. The conduit 78 is connected at the opposite end to a remote air source and the controls for the motor 76 are also provided at the remotely positioned control panel. The motor 76 includes a housing 82 which is suitably supported in the housing 12. The air motor 76 rotates a drive shaft 84 at a variable preselected speed in a preselected direction. Also, the frequency of reversing the direction of rotation of the drive shaft 84 is variable. A pulley 86 is secured for rotation with the drive shaft 84 and rotation of the pulley 86 is transmitted by a drive belt 88 to the pulley 72. The drive belt 88 extends around the pulleys 72 and 86 to transmit rotation of the motor 76 to the nozzle assembly 32. It will be apparent that an electrically operated motor may be used in place of the air motor 76 of the present invention.

Figure 3:
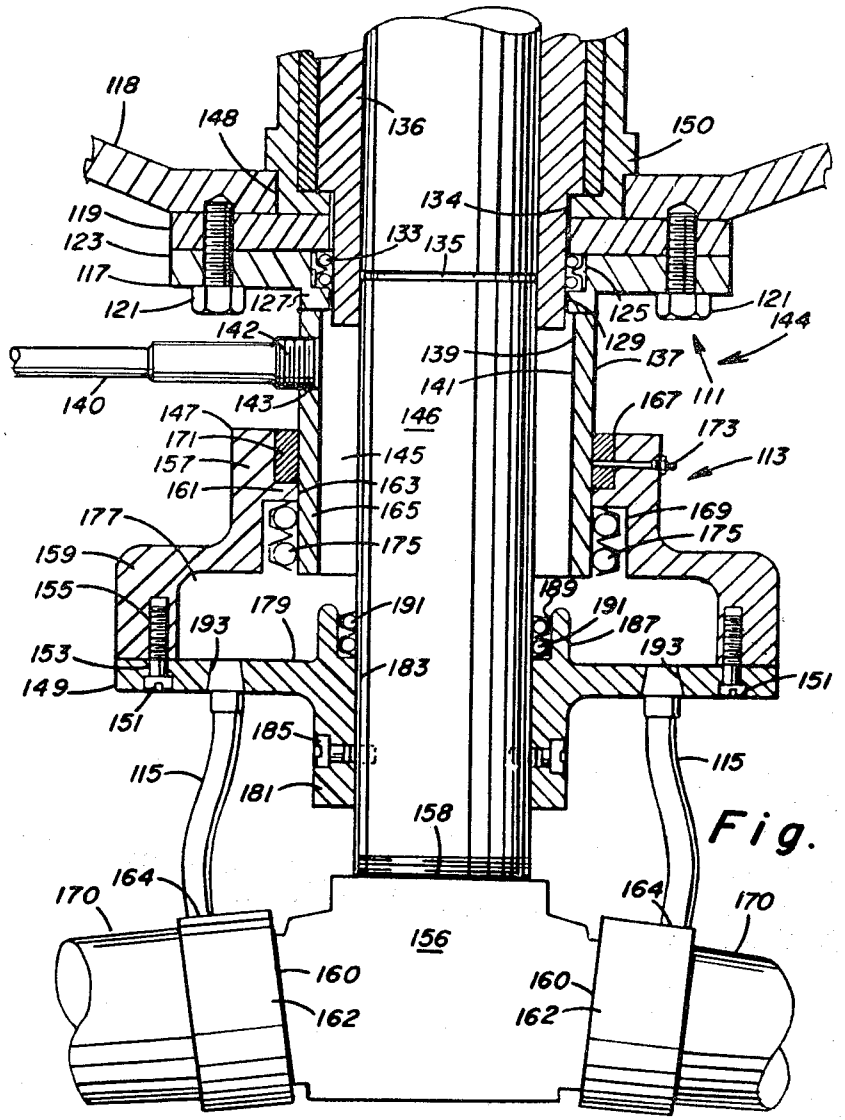
FIG. 3 is an enlarged fragmentary view in section of the swivel device shown in FIG. 2.
Figure 2:
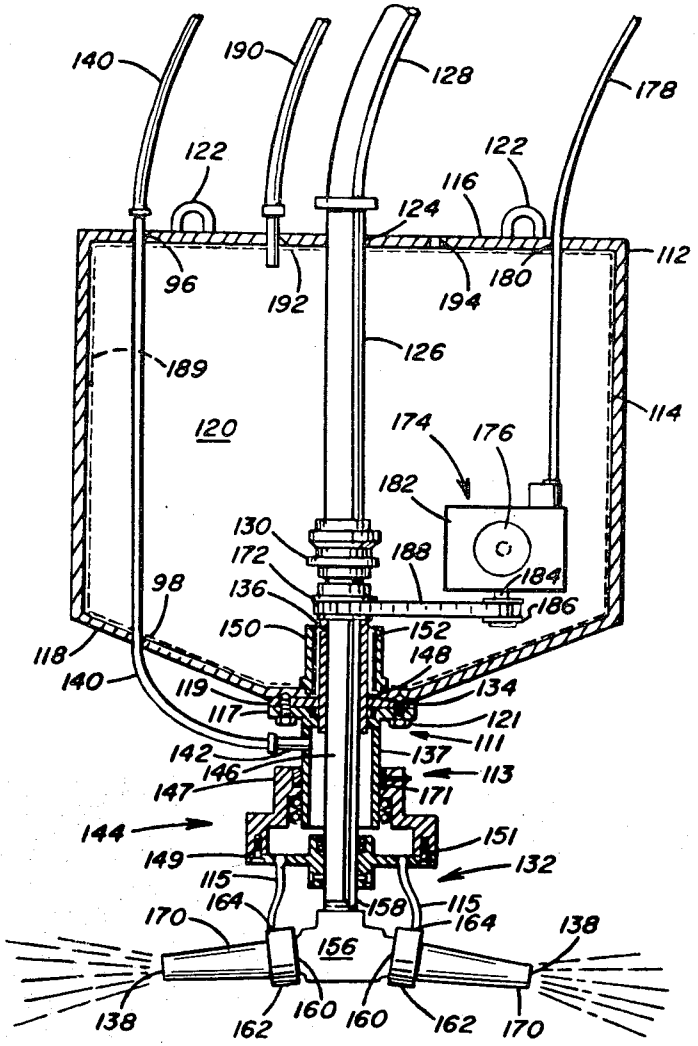
FIG. 2 is a view similar to FIG. 1, illustrating another embodiment of the swivel device.

Now referring to FIGS. 2 and 3 where like numerals raised by 100 refer to like parts illustrated in FIG. 1, there is illustrated a second embodiment of the swivel mechanism generally designated by the numeral 144. The swivel mechanism 144 connects the water supply conduit 140 to the nozzle assembly 132 in a manner to permit rotation of the nozzle assembly 132 relative to the conduit 140 as water, the wetting agent, is conveyed to the nozzle assembly 132. The water supply conduit 140 extends through an opening 96 in the housing cover plate 116 and extends through the interior chamber 120 of the housing 112 to an opening 98 in the conical base 118 of the housing adjacent the housing outlet 134. The conduit 140 extends from the opening 98 and is connected at its outlet end portion 142 to the swivel assembly 144.

The swivel assembly 144, as illustrated in greater detail in FIG. 3, includes a first or fixed portion generally designated by the numeral 111 which is secured to the housing 112 surrounding the outlet 134 thereof and a second or rotatable portion generally designated by the numeral 113. The rotatable portion 113 is rotatably connected at one end to the fixed portion 111 and at an opposite end is connected for rotation with the inlet conduit 146 of the nozzle assembly 132. The fixed portion 111 and the rotatable portion 113 have communicating internal passageways for conveying the wetting agent from the supply conduit 140 through the fixed and rotatable portions 111 and 113 to a pair of conduits 115. The conduits 115 are each connected at one end to outlets of the rotatable portion 113 and at an opposite end to the ports 164 communicating with the mixing chambers of the water rings 162. Accordingly, water is mixed with the dry refractory material in the mixing chambers of the water rings 162 to produce the refractory product that is sprayed in a slurry form from the nozzles 170, as described hereinabove.

The fixed portion 111 of the swivel assembly 144 includes a plate member 117 that is positioned in abutting relation with a flange portion 119 of the sleeve member 150 that is securely positioned in the housing opening 148. The plate member 117 and the flange portion 119 include aligned, threaded bores through which bolts 121 are threadedly advanced to connect the plate member 117 to the flange portion 119. The plate 117, as illustrated in FIG. 3, includes an upper annular portion 123 having an annular recess 125 and a lower annular portion 127 having a bore 129 therethrough. The lower end portion of the sleeve 136 extends through the bore 129. Conventional lubricant seals 133 are positioned in the recess 125 between the sleeve 136 and the upper annular portion 123 to provide a lubricant seal between the plate member 117 and the sleeve 136. As described above, the inlet conduit 146, that conveys the dry refractory material to the water rings 162, extends through the sleeve 136. Preferably, an annular groove is formed on the outer cylindrical surface of the inlet conduit 146 opposite the sleeve 136, and a conventional O-ring seal 135 is positioned in the annular groove to provide a seal between the sleeve 136 and the inlet conduit 146.

The fixed or stationary portion 111 of the swivel assembly 144 also includes a tubular extension 137 that is secured at upper end portion 139 to the lower annular portion 127 of the plate member 117 in a suitable manner, such as by welding as indicated in FIG. 3. The tubular member 137 has an axial bore 141 therethrough, and the upper portion of the bore 141 is positioned in surrounding relation with the lower end of the sleeve 136. As illustrated in FIG. 3, the inside diameter of the tubular member 137 is greater than the outer diameter of the sleeve 136. The tubular member 137 includes an opening 143 extending through the wall of the member 137 and into the bore 141. The tubular member 137 is also concentrically positioned with respect to the inlet conduit 146. With this arrangement, an annulus 145 is formed between the inner cylindrical surface of the tubular member 137 and the outer cylindrical surface of the inlet conduit 146. The annulus 145 communicates with the opening 143 in the tubular member 137. The end portion 142 of the water supply conduit 140 is connected to the fixed portion 111 of the swivel assembly 144 and preferably is connected to the tubular member 137 in the opening 143 so that water is conveyed from the conduit 140 through the opening 143 and into the annulus 145.

The rotatable portion 113 of the swivel assembly 144 is rotatably positioned on the tubular member 137 of the fixed portion 111. Thus, the tubular member 137 is stationarily positioned relative to the nozzle assembly 132. The rotatable portion 113 includes a first member 147 and a second member 149 that is removably connected to the first member 147 by bolts 151 engaging aligned threaded bores 153 and 155 of the first and second members 147 and 149 respectively.

The first member 147 of the rotatable portion 113 includes an upper cylindrical portion 157 and a lower flange portion 159 extending radially outwardly from the cylindrical portion 157. The cylindrical portion 157 has an inwardly projecting annular shoulder 161 having a bore 163 therethrough. A lower end portion 165 of the tubular member 137 extends through the bore 163 in abutting relation with the annular shoulder 161 and extends downwardly therefrom. With this arrangement, an annulus 167 is formed above the annular shoulder 161 between the tubular member 137 and the cylindrical portion 157, and an annulus 169 is formed below the annular shoulder 161 between the tubular member 137 and the cylindrical portion 157.

A bearing device, such as a bronze bushing 171, is press fitted into engagement with the cylindrical portion 157 in the annulus 167 and is arranged for rotation with the first member 147 of rotatable portion 113 relative to the tubular member 137. A conventional lubricant fitting 173 extends through the cylindrical portion 157 and the bushing 171 into communication with the space between the inner cylindrical surface of the bushing 171 and the adjacent outer cylindrical surface of the tubular member 137. With this arrangement, a suitable lubricant is supplied to this space to facilitate rotation of the rotatable portion 113 relative to the fixed portion 111 of the sleeve assembly 144.

To provide a suitable seal between the annular shoulder 161 and the lower end portion 165 of tubular member 137 suitable O-ring type seals 175, such as commercially available Viton seals, are positioned in the annulus 169 below the annular shoulder 161. The seal arrangement prevents flow of water from the annulus 145 up through the cylindrical portion 157 between the cylindrical portion 157 and the tubular member 137.

The first and second members 147 and 149 of the rotatable portion 113 are connected to form an interior fluid chamber 177. The fluid chamber 177 communicates with the annulus 145 which serves as a fluid chamber for the flow of wetting agent thereto from the outlet 142 of the supply conduit 140. The second member 149 includes a circular plate 179 and a lower tubular portion 181. The tubular portion 181 extends downwardly from and is axially aligned with the circular plate 179. A bore 183 extends axially through the plate 179 and tubular portion 181. The inlet conduit 146 extends through the bore 183. Set screws 185 extend through the tubular portion 181 and into the wall of the inlet conduit 146 to nonrotatably connect the tubular portion 181 to the inlet conduit 146. In this manner the rotatable portion 113 is connected to the inlet conduit 146 so that the rotatable portion 113 rotates with the inlet conduit 146 by operation of the drive mechanism 174 as above discussed.

The plate 179 includes an annular shoulder 187 extending into the fluid chamber 177. The annular shoulder 187 forms a recess portion 189 with the upper surface of plate 179, and suitable O-ring type seals 191, such as commercially available Molythane Polypak seals, are positioned in the recess 189. The seals 191 in the recess 189 sealingly engage the outer cylindrical surface of the inlet conduit 146 opposite the annular shoulder 187 to prevent water and/or refractory material from passing between the inlet conduit 146 and the tubular portion 181.

The plate 179 includes a pair of openings 193 extending therethrough and adapted to receive the upper ends of the pair of conduits 115, respectively. The opposite ends of the conduits 115 are connected to the ports 164 that open into the mixing chambers of the water rings 162 to convey the wetting agent from the fluid chamber 177 through the openings 193 and conduits 115 to the rings 162. Thus, with the above described arrangement the wetting agent is conveyed by the supply conduit 140 through the opening 143 into the fluid chamber or annulus 145 of the swivel assembly fixed portion 111 and is conveyed from the annulus 145 to chamber 177 and the openings 193 into the conduits 115. The conduits 115 convey the wetting agent to the mixing chambers of the rings 162 where the wetting agent is mixed with the dry refractory material conveyed from the inlet conduit 146. The wetting agent and dry refractory material are mixed to form a refractory product in slurry form that is sprayed from the nozzles 170. Thus, with the above described arrangement the supply conduit 140 is connected to the nozzle assembly 132 by the swivel assembly 144 in a manner to permit the nozzle assembly 132 to rotate relative to the supply conduit 140 as the wetting agent is conveyed to the nozzle assembly 132.

The relining operation carried out by the gunning apparatus 10 illustrated in FIGS. 1–3 is conducted in situ at the elevated temperature of the refractory body as opposed to the conventional practice of removing the refractory body, such as a ladle or furnace, from operation and cooling it. The following description of the method of operation of the present invention refers to the embodiment illustrated in FIG. 1; however, it should be understood that the described method of operation also applies to the embodiment illustrated in FIGS. 2 and 3. Thus, reference is made to the embodiment of FIG. 1 only for convenience and brevity. The housing 12 is suspended by a crane and lowered, for example, into a ladle which is maintained at its operating temperature which may be in excess of 900° F. Because the housing 12 is subjected to excessive heat the interior components and particularly the drive mechanism 74 are protected by insulating the walls of the interior chamber 20 with a suitable insulation material 89.

Further, in order to protect the motor 76 from the deleterious effects of the surrounding heat, air is injected into the chamber 20 through an air supply conduit 90 that extends through an opening 92 in the cover plate 16. The end of the conduit 90 is retained within chamber 20 and the flow of air through the conduit into the chamber is controlled by the gunning operator. An outlet port 94 in the housing 12 promotes the circulation of air through the chamber 20 and around the motor 76. The air flow is also promoted by the cylindrical configuration of the housing 12. With this arrangement air is supplied to the housing chamber 20 to maintain the motor 76 at a temperature to ensure efficient operation. FIG. 2 also illustrates a corresponding air insulation material 189, air supply conduit 190, opening 192, and outlet port 194.

The operations of supplying the wetting agent to the nozzle assembly 32 through the supply conduit 40, turning the motor 76 off and on to rotate the nozzle assembly, and controlling the direction of rotation and speed of rotation of the nozzle assembly are controlled from a control panel which is preferably located at a position elevated above the refractory body being relined. From this location the operator is in a position to observe the relining operation. The operations of supplying air for cooling the interior of chamber 20 of the housing 12 and conveying the dry refractory material entrained in air through the conduit 28 to the nozzle assembly 32 are controlled by the gun operator who is also positioned remote of the refractory body.

Initially, the gunning apparatus 10 is axially positioned within the interior of the refractory body by lowering the housing 12 supported by a crane at the lifting eyelets 22 into the body. The gunning operation may include a total reconditioning of the refractory body by applying the refractory product to the entire interior surface. For this operation the housing 12 is either lowered at a controlled rate into the body as the refractory product is sprayed onto the interior surface, or in the alternative, the housing 12 may be positioned at the lowermost position within the body and then raised vertically as the interior surface is sprayed. However, for both methods once the housing is selectively positioned within the refractory body, the wetting agent is supplied to the nozzle assembly 32 through the supply conduit 40 and the nozzle assembly is rotated at a preselected speed in a preselected direction. Then the gunning operator feeds the air entrained dry refractory material through the conduit 28 to the nozzle assembly 32. Also, at this time air is supplied through conduit 90 to cool the interior chamber 20 and prevent overheating of the motor 76.

During the relining operation the speed of rotation of the spray nozzles 70 may be varied, as well as the flow rate of water to the water rings 62 and the pressure of the air stream passing through the conduit 28. For relining the complete interior surface of the refractory body rotation of the nozzles 70 serves to uniformly apply the refractory product to the surface being reconditioned so that a refractory coating of a preselected thickness is applied thereto without applying an excessive amount of the refractory product. As noted above the speed of rotation of the nozzles 70 and the rate at which the dry refractory material and water are conveyed to the nozzle assembly 32 determine the thickness of the refractory coating applied to the interior surface of the ladle or furnace. By the hot gunning application of the refractory product, the refractory product sets up more rapidly and less product is wasted. Furthermore, with hot gunning the ladle or furnace is restored to operation in a shorter period of time because the ladle or furnace is not cooled prior to the gunning operation.

The gunning apparatus 10 of the present invention is also readily adaptable to selective or localized application of the refractory product onto the interior surface of a ladle, blast furnace or the like. This is accomplished by initially lowering the housing 12 to an axial position within the ladle where the nozzles 70 are positioned opposite the portion of the ladle interior surface to be repaired. Where only a portion or quadrant of the interior surface is worn and must be repaired by building up the worn quadrant by applying the refractory product thereto, the spray of the refractory product is confined to the quadrant. This is accomplished by rotating the drive shaft 84 in a first direction and reversing rotation of shaft 84 to a second direction with the reversing operation conducted at a preselected frequency. In this manner the nozzle 70 is oscillated through an arc corresponding to the worn quadrant rather than rotating the nozzles through 360° and applying the refractory product to unworn portions of the interior surface. Not only is the angle of the arc of spray variable but the rate of rotation is variable. Thus, the amount of material applied to a portion of the interior surface is controllable, and a selected portion of the interior surface of a ladle or blast furnace may be relined without having to completely reline the entire interior surface. This provides a substantial savings in material and time of operation, permitting the restored refractory body to be returned to operation as soon as possible.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. Method for spraying a refractory product in situ upon the interior surface of a refractory body comprising, positioning a housing at a preselected location opposite said interior surface within said refractory body being maintained at an elevated temperature of operation, conveying a stream of air entrained dry refractory material into an inlet of said housing, rotatably supporting a nozzle assembly in an outlet of said housing, conveying said dry refractory material through said housing to said nozzle assembly, positioning the outlet of a supply conduit in a fixed position relative to said nozzle assembly, connecting said supply conduit outlet to said nozzle assembly by swivel means for rotation of said nozzle assembly relative to said supply conduit outlet, conveying a wetting agent through said supply conduit and said swivel means to said nozzle assembly, mixing said wetting agent and said dry refractory material in a mixing chamber portion of said nozzle assembly to form a refractory product, rotating said nozzle assembly at a preselected speed and in a preselected rotary direction, and applying said refractory product in a spray from said nozzle assembly onto a preselected area of said interior surface of said refractory body while said refractory body is at an elevated operating temperature.

2. Method for spraying a refractory product in situ upon the interior surface of a refractory body as set forth in claim 1 which includes, connecting said supply conduit outlet to a fixed portion of said swivel means, connecting said nozzle assembly to a rotatable portion of said swivel means, rotating said nozzle assembly and said swivel means rotatable portion relative to said swivel means fixed portion, and conveying said wetting agent from said supply conduit outlet through said swivel means fixed and rotatable portions to said nozzle assembly.

3. Method for spraying a refractory product in situ upon the interior surface of a refractory body as set forth in claim 2 which includes, connecting said swivel means rotatable portion to said nozzle assembly mixing chamber portion by conduit means, and conveying said wetting agent from said swivel means rotatable portion through said conduit means to said nozzle assembly mixing chamber portion.

4. Method for spraying a refractory product in situ upon the interior surface of a refractory body as set forth in claim 1 which includes, circulating air throughout said housing to cool the interior of said housing to a temperature below the temperature of said refractory body.

5. Method for spraying a refractory product in situ upon the interior surface of a refractory body as set forth in claim 1 which includes, insulating the interior of said housing from the deleterious affects of the elevated operating temperature of said refractory body.

6. Method for spraying a refractory product in situ upon the interior surface of a refractory body as set forth in claim 1 which includes, rotating said nozzle assembly at a preselected speed in a first rotary direction, reversing the direction of rotation of said nozzle assembly to rotate in a second rotary direction, reciprocating said nozzle assembly through a preselected angle by reversing the direction of rotation of said nozzle assembly, directing a spray of said refractory product from said nozzle assembly onto a selected angular portion of said interior surface of said refractory body corresponding to the angle of rotation of said nozzle assembly, and coating said interior surface of said refractory body with a refractory product layer of a preselected thickness.

7. Method for spraying a refractory product in situ upon the interior surface of a refractory body as set forth in claim 1 which includes, drivingly connecting a drive means positioned within said housing to said nozzle assembly for rotation thereof at a preselected speed in a preselected direction.

8. Method for spraying a refractory product in situ upon the interior surface of a refractory body as set forth in claim 1 which includes, oscillating said nozzle assembly at a variable speed through a preselected angle to spray said refractory product in an arc upon a limited portion of said interior surface of said refractory body being maintained at the elevated operating temperature thereof.

9. Method for spraying a refractory product in situ upon the interior surface of a refractory body as set forth in claim 1 which includes, positioning said nozzle assembly oppositely of a selected portion of said interior surface of said refractory body for coating with said refractory product.

10. A method for applying a refractory product in situ upon the interior surface of a blast furnace comprising, positioning a housing at a preselected location within the interior of said blast furnace being maintained in operation and at an elevated temperature of operation, conveying a stream of air entrained dry refractory material into an inlet of said housing, rotatably supporting a nozzle assembly in an outlet of said housing within the interior of said blast furnace, connecting said nozzle assembly to a supply conduit, conveying a wetting agent through said supply conduit to said nozzle assembly, securing said supply conduit to said nozzle assembly by a swivel mechanism to permit rotation of said nozzle assembly relative to said supply conduit as said wetting agent is conveyed to said nozzle assembly, mixing said dry refractory material and said wetting agent within said nozzle assembly at a position adjacent the location of application of the refractory product upon the interior surface of said blast furnace to form said refractory product, oscillating said nozzle assembly at a preselected speed through an arc of a preselected angle, and spraying said refractory product from said nozzle assembly to apply a coating of said refractory product upon a preselected area of said interior surface of said blast furnace while said blast furnace is in operation and at an elevated operating temperature.

11. A method for applying a refractory product in situ upon the interior surface of a blast furnace as set forth in claim 10 which includes, rotating said nozzle assembly at a preselected direction by a drive mechanism positioned within said housing.

12. A method for applying a refractory product in situ upon the interior surface of a blast furnace as set forth in claim 1 which includes, insulating said drive mechanism within said housing from the elevated operating temperature of said blast furnace surrounding said housing, conveying air into said housing, and circulating said air around said drive mechanism to cool said drive mechanism.

13. A method for applying a refractory product in situ upon the interior surface of a blast furnace as set forth in claim 10 which includes, rotating said nozzle assembly in a first direction, rotating said nozzle assembly in a second direction opposite to said first direction, reversing rotation of said nozzle assembly between said first and second directions to oscillate said nozzle assembly back and forth through an arcuate path, and varying the rate of rotation of said nozzle assembly in said first and second directions to selectively apply said refractory product to a selected portion of said blast furnace interior surface being maintained at the elevated temperature of operation of said blast furnace.

14. A method for applying a refractory product in situ upon the interior surface of a blast furnace as set forth in claim 10 which includes, conveying at a preselected rate of flow said dry refractory material to said nozzle assembly, conveying at a preselected rate of flow said wetting agent to said nozzle assembly, discharging said refractory product from said nozzle assembly in an arcuate spray at a preselected rate to apply a layer of a preselected thickness of said refractory product upon a selected portion of said blast furnace interior surface, and moving said nozzle assembly to a preselected axial position within said blast furnace to apply said refractory product at a selected elevation on said interior surface.

* * * * *